United States Patent [19]

Ishihara et al.

[11] 4,439,504

[45] * Mar. 27, 1984

[54] ELECTROPHOTOGRAPHIC PHOTOSENSITIVE MEMBER AND COLOR ELECTROPHOTOGRAPHIC PROCESS

[75] Inventors: Shunichi Ishihara, Kodaira; Nobuo Kitajima, Toride; Yuji Nishigaki, Tokyo; Nobuko Kitahara, Tama, all of Japan

[73] Assignee: Canon Kabushiki Kaisha, Tokyo, Japan

[ * ] Notice: The portion of the term of this patent subsequent to Aug. 31, 1999 has been disclaimed.

[21] Appl. No.: 302,235

[22] Filed: Sep. 14, 1981

[30] Foreign Application Priority Data

Sep. 18, 1980 [JP] Japan ..... 55-130236

[51] Int. Cl.[3] ..... G03G 13/01; G03G 5/14

[52] U.S. Cl. ..... 430/42; 430/31; 430/46; 430/60; 430/63; 430/66

[58] Field of Search ..... 430/31, 42, 46, 60, 430/63, 66

[56] References Cited

U.S. PATENT DOCUMENTS

| | | | |
|---|---|---|---|
| 2,917,385 | 12/1959 | Byrne | 430/63 |
| 3,005,707 | 10/1961 | Kaumann et al. | 430/63 X |
| 3,226,307 | 12/1965 | Tokumoto | 430/46 X |
| 3,413,117 | 11/1968 | Gaynor | 430/42 X |
| 3,717,460 | 2/1973 | Duck et al. | 430/66 |
| 3,836,363 | 9/1974 | Plutchak | 430/46 |
| 3,941,593 | 3/1976 | Butement | 430/66 X |

*Primary Examiner*—Roland E. Martin, Jr.

*Attorney, Agent, or Firm*—Fitzpatrick, Cella, Harper & Scinto

[57] ABSTRACT

A color electrophotographic process comprises applying voltage between a non-transparent electrode and a color filter electrode of an electrophotographic photosensitive member comprising isolated conductive members forming picture elements, a photoconductive layer, non-transparent electrodes and color filter electrodes, conducting imagewise exposure from the side where color filter electrodes are arranged, resulting in formation of a difference in distribution voltage between the area wherein light passes through the color filter electrode and the area wherein light does not pass through the color filter electrode with regard to the voltage distribution between the non-transparent electrode and the isolated conductive member and between the color filter electrode and the isolated conductive member, thereby forming a voltage image depending upon the change of the voltage of the isolated conductive member caused corresponding to a difference in distribution voltage, and developing said voltage image with a color toner corresponding to a color light passing through the color filter electrode. Further there is disclosed an electrophotographic photosensitive member for a color electrophotographic process as mentioned above.

6 Claims, 11 Drawing Figures

ELECTROPHOTOGRAPHIC PHOTOSENSITIVE MEMBER AND COLOR ELECTROPHOTOGRAPHIC PROCESS

BACKGROUND OF THE INVENTION

1. Field of the Invention

This invention relates to an electrophotographic process for producing color images and an electrophotographic photosensitive member.

2. Description of the Prior Art

According to conventional methods for forming colored images by means of an electrophotographic photosensitive member, original colored images are exposed at least three times and the exposure is effected through a color filter which is usually a red, green or blue filter. After each exposure, the latent images are developed with a toner whose color is a complementary color to the color of the filter to produce toner image according to an electrophotographic process.

For example, a photosensitive member is charged, imagewise exposed through a red filter, developed with a cyan toner and the image thus developed is transferred to a receiving paper and then the same procedure is repeated by using a green filter and a blue filter followed by developing with a magenta toner and a yellow toner, respectively, to produce colored images. When a black toner is used for an additional image forming step for improving image quality of colored images, a somewhat more intensive exposure is effected without using a color filter and a black toner is attached electrostatically to the surface of the photosensitive member corresponding to black portions of the original images.

As mentioned above, conventional colored image formation by electrophotographic means needs at least three exposures with different filters and the procedures are complicated. Further, in conventional methods, between the three exposures and developments there are effected corona chargings, but in case of corona charging, it is, in general, very difficult to control the electric charge amount. Therefore, control of the tone of color images is effected by adjusting the exposure amount. Such a way of controlling the tone can not be easily effected at a high accuracy, and further, it is more difficult to control each color tone separately.

SUMMARY OF THE INVENTION

It is an object of the present invention to provide a color electrophotographic process capable of controlling easily the total tone of colored images formed by electrode voltages and capable of controlling individually each color tone.

It is another object of the present invention to provide an electrophotographic photosensitive member used for the above mentioned color electrophotographic process.

According to the present invention, there is provided a color electrophotographic process which comprises applying voltage between a non-transparent electrode and color filter electrode of an electrophotographic photosensitive member, comprising isolated conductive members forming picture elements, a photoconductive layer, non-transparent electrodes and color filter electrodes. Imagewise exposure is then conducted from the side where color filter electrodes are arranged, resulting in the formation of a difference in distribution voltage between the area wherein light passes through the color filter electrode and the area wherein light does not pass through the color filter electrode with regard to the voltage distribution between the non-transparent electrode and the isolated conductive member and between the color filter electrode and the isolated conductive member. Accordingly, a voltage image is formed depending upon the change of the voltage of the isolated conductive member corresponding to a difference in distribution voltage, and said voltage image is developed with a color toner corresponding to a color light passing through the color filter electrode.

According to another aspect of the present invention, there is provided a color electrophotographic process which comprises a step of applying voltage between a non-transparent electrode and a color filter electrode of an electrophotographic photosensitive member, comprising isolated conductive members forming picture elements, a photoconductive layer, transparent electrodes, non-transparent electrodes and color filter electrodes. Imagewise exposure is then conducted from the side where color filter electrodes are arranged, resulting in the formation of a difference in distribution voltage between the area wherein light passes through the color filter electrode and the area wherein light does not pass through the color filter electrode with regard to the voltage distribution between the non-transparent electrode and the isolated conductive member and between the color filter electrode and the isolated conductive member. Accordingly, a voltage image is formed depending upon the change of the voltage of the isolated conductive member corresponding to a difference in distribution voltage, and said voltage image is developed with a color toner corresponding to a color light passing through the color filter electrode. A further step comprises applying voltage between a transparent electrode and a non-transparent electrode. Imagewise exposure is then conducted from the side where non-transparent electrodes are arranged, resulting in the formation of a difference in distribution voltage between the area wherein light passes through the transparent electrode and the area wherein light does not pass through the transparent electrode with regard to the voltage distribution between the non-transparent electrode and the isolated conductive member and between the transparent electrode and the isolated conductive member. Accordingly, a voltage image is formed depending upon the change of the voltage of the isolated conductive member corresponding to a difference in distribution voltage, and said voltage image is developed with a black toner.

According to a further aspect of the present invention, there is provided an electrophotographic photosensitive member which comprises isolated conductive members forming picture elements, a photoconductive layer, non-transparent electrodes and color filter electrodes.

BRIEF DESCRIPTION OF THE DRAWINGS

FIG. 4 represents the developing step with a cyan toner, FIG. 5 the developing step with a magenta toner, FIG. 6 the developin step with a yellow toner and FIG. 7 the developing step with a black toner.

DESCRIPTION OF THE PREFERRED EMBODIMENTS

Figure 1:
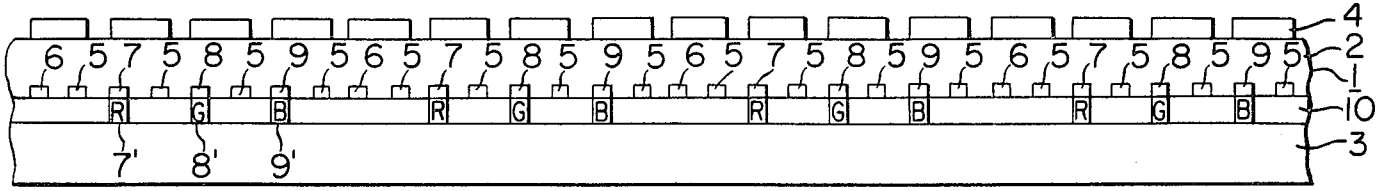
FIGS. 1 and 8–11 show embodiments of the electrophotographic photosensitive member according to the present invention.

Referring to FIG. 1 one of the representative embodiments of the electrophotographic photosensitive member used for the color electrophotographic process of the present invention is illustrated. The photosensitive member 1 is composed of substrate 3, filter layer 10, electrode-photoconductive layer 2 and isolated conductive member 4. As electrodes, there are provided periodically at regular intervals non-transparent electrode 5, transparent electrode 6, red filter electrode 7 having red filter 7', green filter electrode 8 having green filter 8' and blue filter electrode 9 having blue filter 9'. Substrate 3 is transparent and is made of glass, resin $\gamma$ and the like. Transparent electrode 6 is dispensable. Filter layer 10 having red filter 7', green filter 8' and blue filter 9' be prepared by any of the methods for producing conventional color filters. Representative methods are "vapor deposition method" and "coloring method".

The vapor deposition method is to make the color filter with an interference filter, wherein thin films, each having different refractive indexes, are vapor deposited on the substrate through a mask in a plurality of laminated layers to a predetermined thickness so that only a desired wavelength region of light (color) may be transmitted by the interference effect of the light, thereby forming the color filters in red, green, blue, etc.

The non-transparent electrode may be formed by vapor-depositing or coating a metal such as Al, Ag, Pb, Ni, Au, Cr, and the like, or a black dye as mentioned later, and then forming a transparent electrode thereon.

The coloring method is to form the filter layer by coating the substrate with a resin material such as polyvinyl alcohol, gelatin, polyurethanes, polycarbonates, etc. to provide a dye accepting layer, to which a dyestuff is applied. In order to form each of the non-transparent, red, green, and blue filters, there will usually be performed the process steps of forming a mask on the dye accepting layer using a photoresist, then applying a dyestuff in one color to a predetermined portion, and removing the mask by etching. The process steps are repeated for each filter.

The representative dyestuffs for use in the color filter according to the present invention are as follows.

(1) Acceptable sublimable red dyes: Celliton Scarlet B (supplied by BASF), Diacelliton Fast Pink R (supplied by Mitsubishi Chemical Industrial Ltd.), Terasil Brilliant Pink 4BN (supplied by Ciba-Geigy Ltd.), Kayanal Red R (supplied by Nippon Kayaku Co., Ltd.), Sumikaron Red E-FBL (supplied by Sumitomo Chemical Co., Ltd.), Resolin Red FB (supplied by Bayer AG.), Sumiacryl Rhodamine 6GCP (supplied by Sumitomo Chemical Co., Ltd.), Aizen Cathilon Pink FGH (supplied by Hodogaya Chemical Co., Ltd.), Maxilon Brilliant Red 4G (supplied by Ciba-Geigy Ltd.), Diacryl Supra Brilliant Pink R-N (supplied by Mitsubishi Chemical Industrial Ltd.), and the like.

Acceptable red dyes for application: Suminol Fast Red B conc. (supplied by Sumitomo Chemical Co., Ltd.), Aizen Brilliant Scarlet 3 RH (supplied by Hodogaya Chemical Co., Ltd.), Azo Rubinol 3GS 250% (supplied by Mitsubishi Chemical Industrial Ltd.), Kayaku Acid Rhodamine FB (supplied by Nippon Kayaku Co., Ltd.), Acid Anthracene Red 3B (supplied by Chuhgai Chemical Co., Ltd.), Benzyl Fast Red B (supplied by Ciba-Geigy Ltd.), Palatine Fast Red RN (supplied by BASF), Nylomine Red 2BS (supplied by I.C.I. Ltd.), Lanafast Red 2GL (supplied by Mitsui-Toatsu Chemicals Inc.), Rose Bengal (supplied by Kii Chemical Industry Ltd.) and the like.

(2) Acceptable sublimable green dyes: Aizen Diamond Green GH (supplied by Hodogaya Chemical Co., Ltd.), Aizen Malachite Green (supplied by Hodogaya Chemical Co., Ltd.), Brilliant Green (supplied by E.I. du pont de Nemours & Co., Inc.), Fast Green JJO (supplied by Ciba-Geigy Ltd.), Synacril Green G (supplied by I.C.I. Ltd.), Victoria Green (supplied by E.I. du pont de Nemours & Co., Inc.), and the like.

Acceptable green dyes for application: Kayakalan Blue-Black 3BL (supplied by Nippon Kayaku Co., Ltd.), Sumilan Green BL (supplied by Sumitomo Chemical Co., Ltd.), Aizen Floslan Olive Green GLH (supplied by Hodogaya Chemical Co., Ltd.), Diacid Cyanine Green GWA (supplied by Mitsubishi Chemical Industrial Ltd.), Cibalan Green GL (supplied by Ciba-Geigy Ltd.), Carbolan Brilliant Green 5G (supplied by I.C.I Ltd.), Palatine Fast Green BLN (supplied by BASF), Acid Green GBH (supplied by Takaoka Chemical Co., Ltd.), Acid Brilliant Milling Green B (supplied by Mitsui-Toatsu Chemicals Inc.), and the like.

Also, green can be produced by incorporation of blue and yellow dyes.

(3) Acceptable sublimable blue dyes: Miketon Fast Blue Extra (supplied by Mitsui-Toatsu Chemicals Inc.), Kayanal Fast Blue FN (supplied by Nippon Kayaku Co., Ltd.), Sumikaron Blue E-BR (supplied by Sumitomo Chemical Co., Ltd.), Terasil Blue 2R (supplied by Ciba-Geigy Ltd.), Palanil Blue R (supplied by BASF), Aizen Brilliant Basic Cyanine 6GH (supplied by Hodogaya Chemical Co., Ltd.), Aizen Cathilon Blue GLH (supplied by Hodogaya Chemical Co., Ltd.), Cibacet Blue F3R (supplied by Ciba-Geigy Ltd.), Diacelliton Fast Brilliant Blue B (supplied by Mitsubishi Chemical Industrial Co., Ltd.), Dispersol Blue BN (supplied by I.C.I Ltd.), Resolin Blue FBL (supplied by Bayer A.G.), Latyl Blue FRN (supplied by E.I. du Pont de Nemours & Co., Inc.), Sevron Blue ER (supplied by E.I. du pont de Nemours & Co., Ltd.), Diacryl Brilliant Blue H2R-N (supplied by Mitsubishi Chemical Industrial Co., Ltd.) and the like.

Acceptable blue dyes of application: Orient Soluble Blue OBC (supplied by Orient Chemical Co., Ltd.), Suminol Leveling Blue 4GL (supplied by Sumitomo Chemical Co., Ltd.), Kayanal Blue N2G (supplied by Nippon Kayaku Co., Ltd.), Mitsui Alizarine Saphirol B (supplied by Mitsui-Toatsu Chemicals Inc.), Xylene Fast Blue BL 200% (supplied by Mitsubishi Chemical Industrial Co., Ltd.), Alizarine Fast Blue R (supplied by Ciba-Geigy Ltd.), Carbolan Brilliant Blue 2R (supplied by I.C.I. Ltd.), Palatine Fast Blue GGN (supplied by BASF), Aizen Opal Blue New conc. (supplied by Hodogaya Chemical Co., Ltd.), Fastogen Blue SBL (supplied by Dainihon Ink Chemical Co., Ltd.), and the like.

Acceptable black dyes: Suminol Fast Black BR conc. (supplied by Sumitomo Chemical Co., Ltd.), Diacelliton Fast Black T (supplied by Mitsubishi Chemical Industrial Ltd.), Miketazol Black 3GF (supplied by Mitsui-Toatsu Chemicals Inc.), Kayalon Diazo Black 2GF (supplied by Nippon Kayaku Co., Ltd.), and Aizen Opal Black WGH (supplied by Hodogaya Chemical Co., Ltd.) and the like.

All the above-mentioned names represent trade names.

The cyan, magenta and yellow dyes may be optionally selected for use from commercially available ones.

Each of electrodes 7–9 is formed by the following step. On the filter layer is deposited, by vacuum evaporation, a material for transparent electrodes, for example, $In_2O_3$, $SnO_2$, In-Sn-O etc., or metals such as Au, Cu, and the like in a thin film state. Thereafter, a comb shape of masking pattern is formed by using photoresists, then the layer of $In_2O_3$ etc. is selectively removed by using the predetermined etching agents, such as acids or alkalis, and the masking pattern of the photoresists is removed to form a transparent electrode.

Materials which are already generally used for photoresist can be used as photoresist for forming color filters and electrodes. For example, the following are commercially available: KPR (trade name, Kodak Photo Resist; supplied by Kodak . . . developer: methylene chloride, trichlene etc.), KMER (trade name, Kodak Metal Etch Resist: supplied by Kodak . . . developer: Xylene, trichlene etc.), TPR (trade name; supplied by Tokyo Ohka . . . developer: Xylene, trichlene etc.), Shipley AZ 1300 (trade name, supplied by Shipley . . . developer: alkali aqueous solution), KTFR (trade name, Kodak Thin Film Resist; supplied by Kodak . . . developer: Xylene, trichlene etc.), FNRR (trade name; supplied by Fuji Yakuhin Kogyo Co., Ltd. . . . developer: Chlorcene), FPER (trade name, Fuji Photo Etching Resist; supplied by Fuji Photo Film Co., Ltd. . . . developer: trichlene), TESH DOOL (trade name; supplied by Okamoto Chemical Industrial Co., Ltd. . . . developer: water), Fuji-Resist No. 7 (trade name; supplied by Fuji Yakuhin Kogyo Co., Ltd. . . . developer: water); and the like. Further, there are used trichlene, methylene chloride, AZ Remover (trade name; supplied by Shipley), sulfuric acid and the like for removing the used mask.

Formation of each electrode may be done by vapor-deposition of an electrode forming material on the substrate through a mask having therein a comb-shaped opening, followed by removal of the mask. Thickness of the electrode usually ranges from 500 Å to 6,000 Å.

Figure 2:
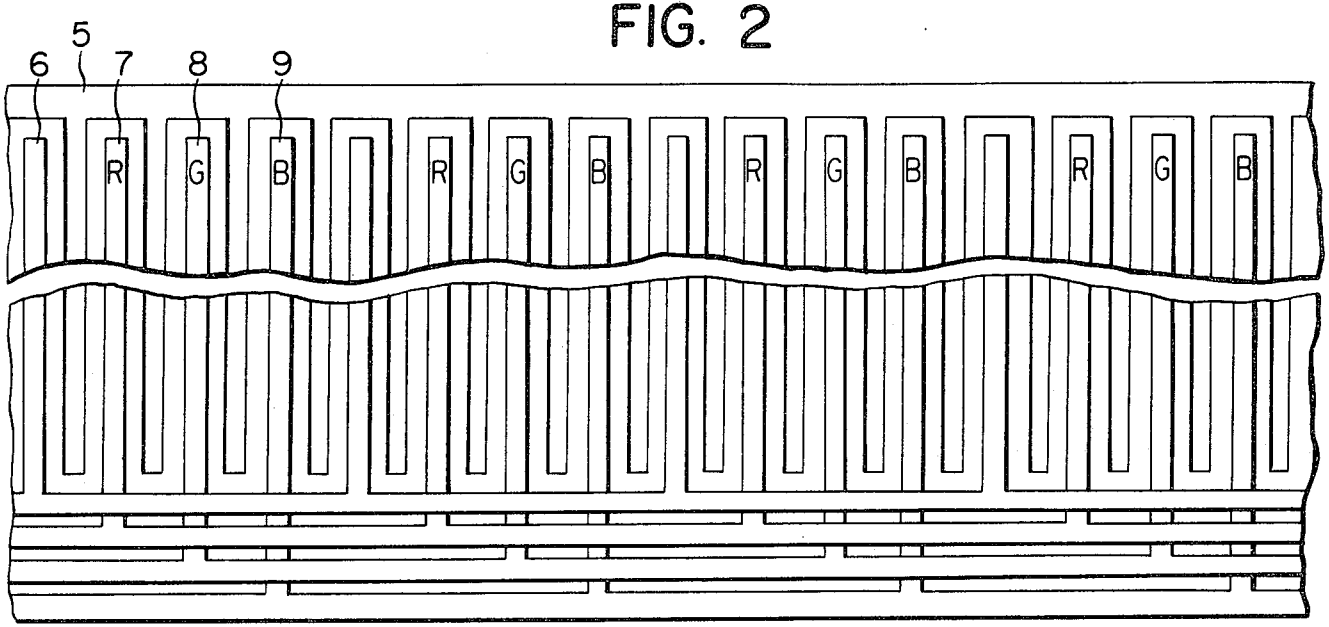
FIG. 2 is a plan view of the electrode pattern of the electrophotographic photosensitive member of FIG. 1.

The electrode formed on each color filter operates as a color filter electrode. FIG. 2 is a plan view of color filter electrodes of the photosensitive member in FIG. 1 thus produced and the electrodes are comb-shaped ones. Color filter electrode 7, 8 or 9 and each non-transparent electrode 5 are in juxtaposed relationship and portions where the color electrodes 7–9 overlap each other are electrically insulated by, for example, interposing an insulating paint therebetween.

The photoconductive layer 2 is formed by a vacuum deposition of an inorganic photoconductive material such as S, Se, Si, PbO, or alloys and intermetallic compounds containing therein S, Se, Te, As, Sb, etc. When a sputtering method is used, a photoconductive substance of a high melting point such as ZnO, CdS, CdSe, $TiO_2$, and the like may be deposited on a substrate to form the photoconductive layer. In the case of forming the photoconductive layer by coating, there may be used various organic photoconductive materials such as polyvinyl carbazol, anthracene, phthalocyanine, and so forth, or such organic photoconductive materials which have been color-sensitized or Lewis acid-sensitized, or a mixture of such an organic photoconductive material and an insulative binder. A mixture of inorganic photoconductive materials such as ZnO, CdS, $TiO_2$, PbO, and the like, and an insulative binder is also suited for the purpose. For the insulative binder, there may be used various sorts of resins. Thickness of the photoconductive layer, though it depends on the kind and characteristics of the photoconductive material to be used, may generally range from 5 to 100 microns, or more preferably from 10 to 50 microns or so.

Figure 3:
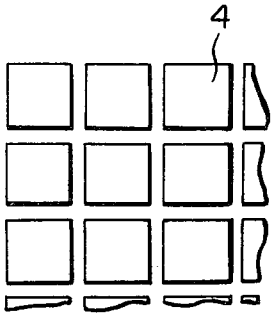
FIG. 3 is a plan view of the isolated conductive members of the electrophotographic photosensitive member of FIG. 1.

The isolated electrically conductive members 4 are discrete insular bodies of an electrically conductive substance, which are important to constitute elements of an image. In FIG. 3, each of the isolated electrically conductive members is in a square form. Formation of the isolated electrically conductive member can be done in exactly the same manner as in the case of the color filter electrodes.

A representative process for producing color images by using the photosensitive member as shown in FIG. 1 is illustrated in FIGS. 4–7.

STEP 1

Voltage Va is applied between electrodes 5 and 7. It is now assumed that electrode 7 is earthed. Under such conditions as above, a light from an original image is projected to the photosensitive member. When the light is black, or is a light not containing red, that is, when the light corresponds to black portions or green and blue portions, no light comes to the portion of photoconductive layer 2 on the electrode 7 nor the portion of photoconductive layer 2 on the electrode 5 so that those portions are at a dark state. The resistance between electrode 7 and isolated conductive member 4 is designated as $R_7$ (black.dark) and the resistance between electrode 5 and isolated conductive member 4 is designated as $R_5$ (black.dark). Therefore, voltage Vo formed in the isolated conductive member is as shown below:

$$Vo = \frac{R_7(\text{black} \cdot \text{dark})}{R_7(\text{black} \cdot \text{dark}) + R_5(\text{black} \cdot \text{dark})} Va$$

If structure, area, and the like, of electrodes 7 and 5 are the same, the voltage Vo of the isolated conductive member is $\frac{1}{2}$ Va.

Then, when a white light and a red light are projected, (that is, the light corresponding to white portions of the original image, (wherein white portions are not illustrated in the Figure, and to the red portions of the original image), the portion of the photoconductive layer on the electrode 7 is irradiated, while the portion of the photoconductive layer 2 on the electrode 5 is not irradiated, so that the resistance between electrode 7 and the isolated conductive member 4 is at a light state and they can be designated as $R_7$(red·light) and $R_7$(white·light). But the resistance between electrode 5 and isolated conductive member 4 is at a dark state and is designated as $R_5$(dark).

When the intensity of projected light is sufficient and the photoconductivity of the photoconductive layer is sufficiently high, it appears that $R_7$(red·light)=$R_7$(white·light)=R(light).

As a result, the voltage Vo formed at the isolated conductive members 4 corresponding to the white portion and the red portion is as shown below:

$$Vo = \frac{R_7(\text{light})}{R_7(\text{light}) + R_5(\text{dark})} Va$$

When the photoconductive characteristic is more than three digits, $R_5(\text{dark})/R_7(\text{light}) > 10^3$ and therefore, $Vo=0$.

Figure 4:
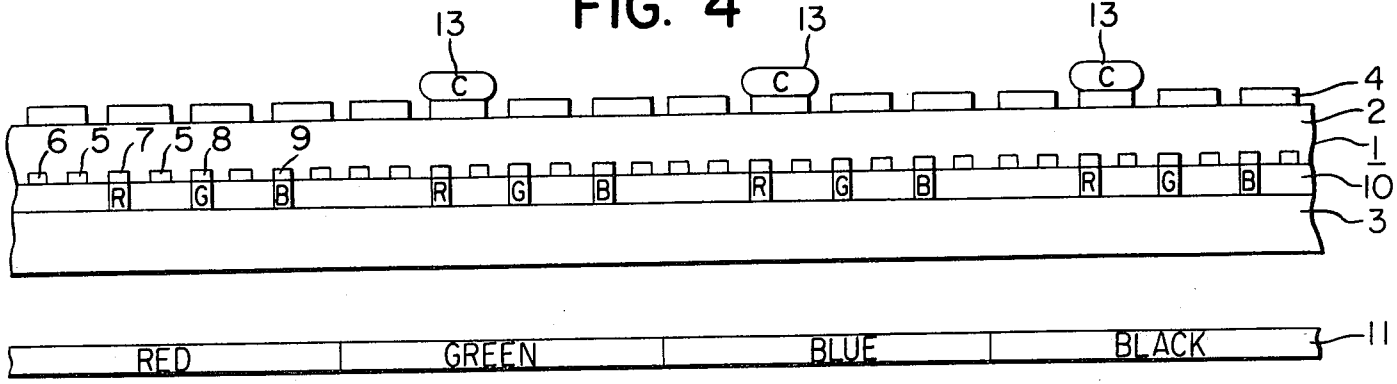
FIGS. 4 - 7 show diagrammatically the color electrophotographic process according to the present invention.

When development is effected, under these conditions, with a transparent cyan toner of an opposite polarity to that of voltage Va, cyan toner 13 attaches only to isolated conductive members corresponding to green, blue and black portions of the original image as illustrated in FIG. 4.

When the developed images are transferred to a paper, toner images are produced corresponding to the portions containing black or cyan color of the original image.

STEP 2

Then, voltage Va is applied between electrodes 8 and 5 assuming that electrode 8 is earthed. The value Va may or may not be the same as Va at STEP 1.

Then a light image from the original is projected under the above-mentioned condition. When no light is projected from the black portion of the original and a light not containing green light is projected, that is, lights corresponding to red and blue portions of the original are projected, no light comes to the portion of photoconductive layer 2 on electrode 8 and that on electrode 5 and, therefore, a dark state is formed. Resistance between electrode 8 and isolated conductive member 4 is $R_8$(dark). Thus voltage Vo formed in the isolated conductive members 4 corresponding to black, red and blue portions of the original is as follows:

$$Vo = \frac{R_8(\text{dark})}{R_8(\text{dark}) + R_5(\text{dark})} Va$$

Where structures, areas and the like of electrodes 8 and 5 are the same, voltage Vo is equal to $\frac{1}{2}$ Va.

When a white light and a green light are projected, that is, lights coming from white and green portions of the original, lights are projected to the portions of photoconductive layer 2 on electrode 8, and a light state is formed there. The resistance between electrode 8 and isolated conductive member 4 is designated as $R_8$(light) and the resistance between electrode 5 and isolated conductive member 4 is designated as $R_5$(dark).

As a result, voltage Vo at the isolated conductive members corresponding to the white portion and the green portion of the original image is as shown below:

$$Vo = \frac{R_8(\text{light})}{R_8(\text{light}) + R_5(\text{dark})} Va$$

When the photoconductive characteristics are more than three digits, $R_5(\text{dark})/R_8(\text{light}) > 10^3$ and therefore, $Vo=0$.

Figure 5:
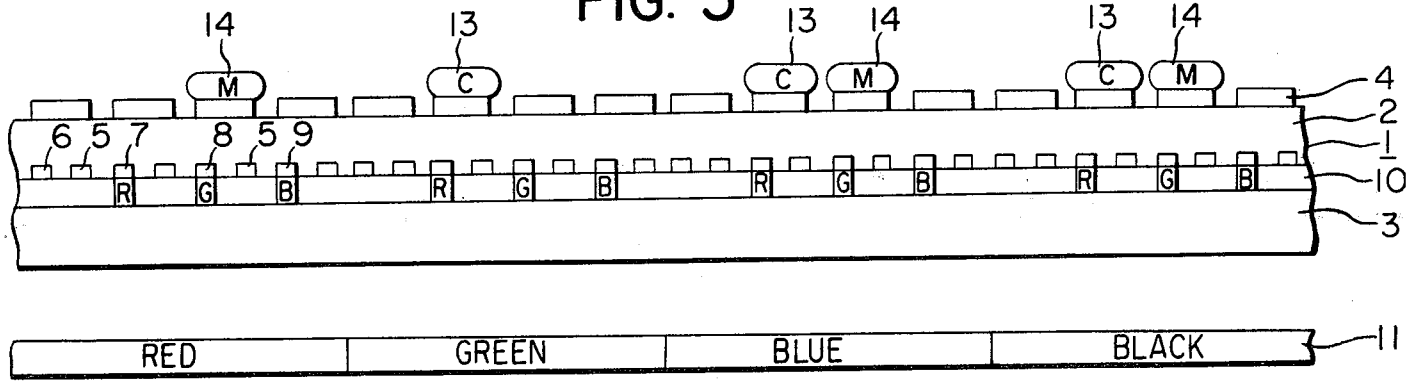

Under these conditions, development is effected with a transparent magenta toner of an opposite polarity to that of voltage Va, and magenta toner 14 attaches only to isolated conductive members corresponding to black, red and blue portions of the original image as shown in FIG. 5.

The images thus developed are transferred to the paper bearing a cyan toner image transferred in STEP 1. As a result, toner images are produced corresponding to cyan and magenta portions of the original image.

STEP 3

Then, voltage Va is applied between electrodes 9 and 5, assuming that electrode 9 is earthed. The value Va may or may not be the same as Va at STEP 1 and STEP 2. While the voltage is applied, a light from the original image is projected, and when there is no projection of black, red and green lights, that is, no projection of lights corresponding to black, red and green portions of the original image, neither the portion of photoconductive layer 2 corresponding to electrode 9 nor that corresponding to electrode 5 is irradiated so that it is a dark state, and the resistance between electrode 9 and isolated conductive member 4 is designated as $R_9$ (dark) and the resistance between electrode 5 and isolated conductive member 4 is designated as $R_5$(dark). Therefore, voltage Vo at the isolated conductive members 4 corresponding to black, red and green portions of the original image is as shown below:

$$Vo = \frac{R_9(\text{dark})}{R_9(\text{dark}) + R_5(\text{dark})} Va$$

When structures, areas, and the like, of electrodes 9 and 5 are the same, $Vo=\frac{1}{2}Va$.

Then, when white light and blue light are projected (in the case of white and blue portions of the original image), the portion of photoconductive layer 2 on electrode 9 is irradiated and is at a light state. The resistance between electrode 9 and isolated conductive member 4 is $R_9$(light) and the resistance between electrode 5 and isolated conductive member 4 is $R_5$(dark).

Therefore, voltage Vo at the isolated conductive members corresponding to the white portion and blue portion of the original image is as shown below:

$$Vo = \frac{R_9(\text{light})}{R_9(\text{light}) + R_5(\text{dark})} Va$$

and when the photoconductive characteristics are more than three digits, there is a relation, i.e. $R_5(\text{dark})/R_9(\text{light}) > 10^3$, and thus $Vo=0$.

Figure 6:
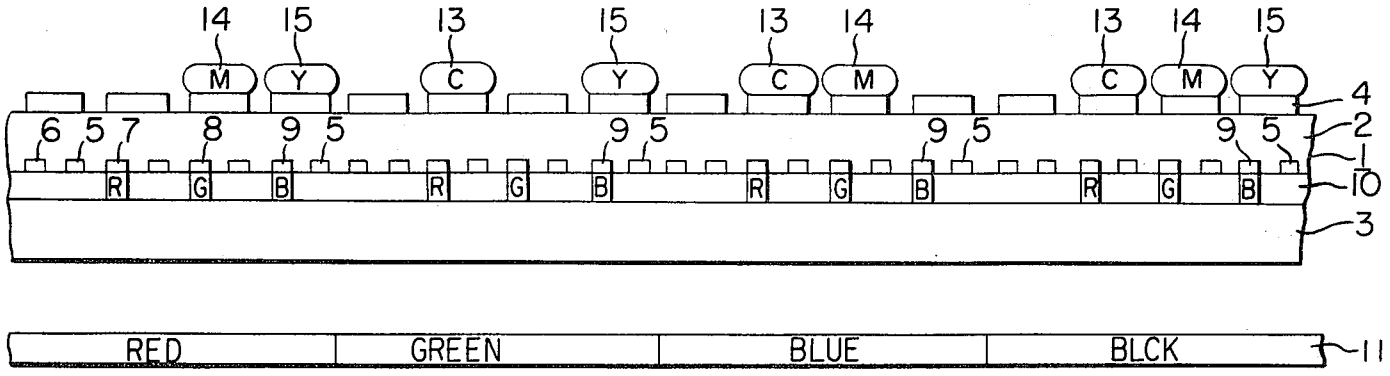

Under these conditions, when development is effected with a transparent yellow toner having a polarity opposite to that of the inpressed voltage Va, yellow toner 15 attaches to the isolated conductive members corresponding to the black, green and red portions of the original image as shown in FIG. 6.

The images thus developed are transferred to the paper having cyan and magenta toner images transferred in STEP 1 and STEP 2, and full color images are produced corresponding to the original images.

In the above step, the black portions of the original are reproduced by the combination of cyan, magenta and yellow toners, but the complete black can be obtained only when the three colors are well balanced. Therefore, sometimes there is formed a black color which is not a complete black.

In view of the foregoing, if desired, the following STEP 4 may be effectively used.

STEP 4

Voltage Va is applied between electrode 5 and electrode 6, assuming that electrode 6 is earthed and a light is projected from the original image 11, since the portions of photoconductive layer 2 on electrode 5 are not irradiated so that said portions are always at a dark state, and the photoconductive layer between electrode 5 and isolated conductive member 4 is at a dark state. The resistance at this state is designated as $R_5$(dark). When no light is projected from the black portion of the original, no light comes to the portion of photoconductive layer 2 on electrode 6, and therefore, a dark state is formed. The resistance between electrode 6 and isolated conductive member 4 is designated as $R_6$(black.dark).

On the contrary, the portions of photoconductive layer 2 on electrode 6 corresponding to white, red, green and blue dependent upon the color tone of the original image are at a light state. The resistance between electrode 6 and isolated conductive member 4 may be represented by $R_6$(white·light), $R_6$(red·light), $R_6$(green·light) and $R_6$(blue·light).

Voltage Vo formed in the isolated conductive member 4 corresponding to black portions of the original is:

$$Vo = \frac{R_6(\text{black} \cdot \text{dark})}{R_6(\text{black} \cdot \text{dark}) + R_5(\text{dark})} Va$$

When structures, areas, and the like, of electrodes 5 and 6 are the same, it appears that $R_6$(black·dark)=$R_5$(dark), and therefore, voltage Vo at the isolated conductive members corresponding to black portions of the original is ½Va.

When intensity of the light is high, it is easy to make the resistance of the photoconductive layer when irradiated with any one of white, red, green and blue lights lower than that at a dark state by three digits in the case of ordinary photoconductive materials.

Therefore, any of $R_5$(dark)/$R_6$(white·light), $R_5$(dark)/ $R_6$(red·light), $R_5$(dark)/$R_6$(green·light) and $R_5$(dark)/$R_6$(blue·light) can be $>10^3$.

Figure 7:
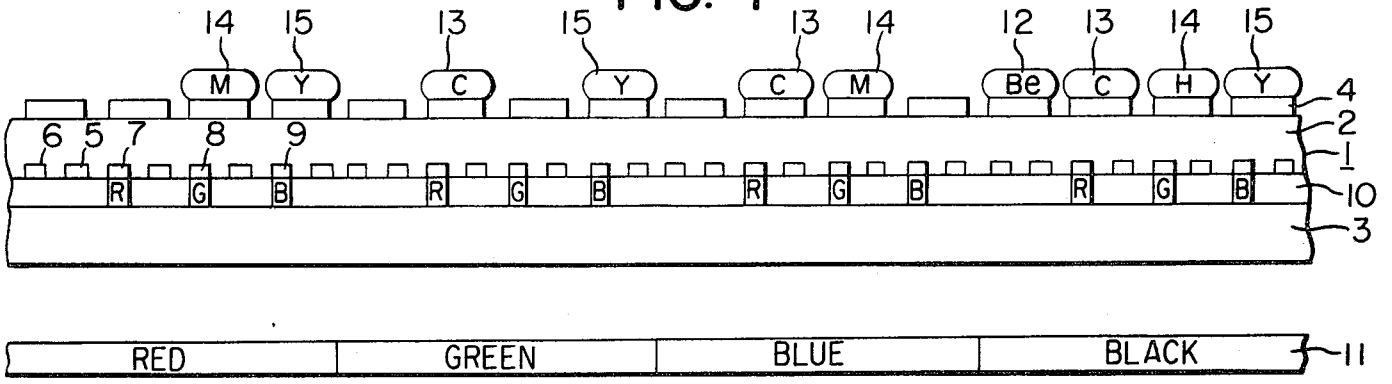

Under these conditions, voltage Vo produced at an isolated conductive member corresponding to the white, red, green or blue portion of the original is Vo=0. At this stage, when development is conducted with a black toner of an opposite polarity to the voltage Vo, black toner 12 attaches only to an isolated conductive member corresponding to a black portion of the projected light image as shown in FIG. 7. When the resulting black toner image is transferred to a paper, a black image corresponding to the black portion of the projected image is reproduced.

The relation between the voltage of isolated conductive member and toners attaching thereto in the above process is shown in the following table.

TABLE

| Step Original Image | 4 | 1 | 2 | 3 | Color of Copy |
|---|---|---|---|---|---|
| Black | $\frac{Vo}{2}$ Black toner attaches | $\frac{Vo}{2}$ Cyan toner attaches | $\frac{Vo}{2}$ Magenta toner attaches | $\frac{Vo}{2}$ Yellow toner attaches | Black |
| White | 0 | 0 | 0 | 0 | White |
| Red | 0 | 0 | $\frac{Vo}{2}$ Magenta toner attaches | $\frac{Vo}{2}$ Yellow toner attaches | Red |
| Green | 0 | $\frac{Va}{2}$ Cyan toner attaches | 0 | $\frac{Va}{2}$ Yellow toner attaches | green |

TABLE-continued

| Step Original Image | 4 | 1 | 2 | 3 | Color of Copy |
|---|---|---|---|---|---|
| Blue | 0 | $\frac{Vo}{2}$ Cyan toner attaches | $\frac{Vo}{2}$ Magenta toner attaches | 0 | Blue |

In the above table, if a toner attaches to even an isolated conductive member whose surface voltage is zero and fog is formed, such disadvantage can be eliminated by a conventional method such as placing a counter electrode upon development and applying a voltage which is a value between Va/2 and zero.

The order of steps 1–4 is completely optional and the process may be started from any step. The transfer of toner may be effected at each individual step, but all toners attached to the photosensitive member in steps 1–4 may be transferred at once.

When, in place of the cyan, magenta, and yellow toners, other toners of optionally predetermined color tones are employed, a color copy having color tones different from those of the original image, that is, a color changed copy, can be produced.

As explained above, referring to the photosensitive member as shown in FIG. 1, the process of the present invention can give color images, and a tone of the colored image can be easily controlled by adjusting the voltage applied to electrodes of the photosensitive member.

The photosensitive member and the color electrophotographic process according to the present invention may be further carried out by other various embodiments, as well as by the photosensitive member shown in FIG. 1 and the process comprising the foregoing steps 1–4. Other representative embodiments will be explained below.

Figure 8:
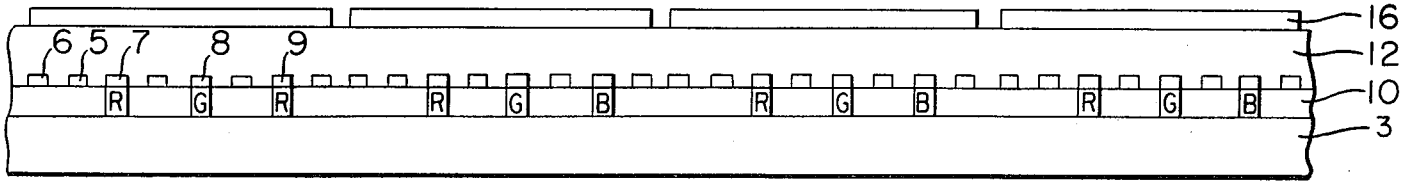
Figure 9:
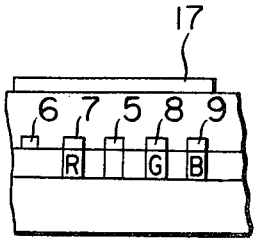

FIGS. 8 and 9 show other photosensitive members, respectively.

A photosensitive member shown in FIG. 8 is provided with isolated conductive members 16 having a relatively large area so that each conductive member covers a set of electrodes, that is, a transparent electrode 6, non-transparent electrodes 5, a red filter electrode 7, a green filter electrode 8 and a blue filter electrode 9. In the case of forming a colored image by using the above mentioned photosensitive member, voltage is applied between each filter electrode and an isolated conductive member which is common to each filter electrode with regard to voltage distribution between each filter electrode and the isolated conductive member, and between the non-transparent electrode and the isolated conductive member. Consequently, two or more colored toners can adhere to one isolated conductive member in such a state that the colored toners are mixed. This state favors improved reproducibility of a colored image.

A photosensitive member shown in FIG. 9 represents a photosensitive member comprising one non-transparent electrode 5 per one set of the electrodes in place of one non-transparent electrode provided between two color filter electrodes. Reference numeral 17 denotes an isolated conductive member. In such a photoconductive member, the number of non-transparent electrodes is so small that production of the photosensitive member becomes simpler in proportion to the smaller number of non-transparent electrodes.

Figure 11:
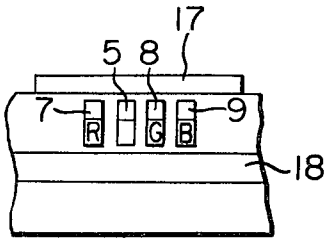
Figure 10:
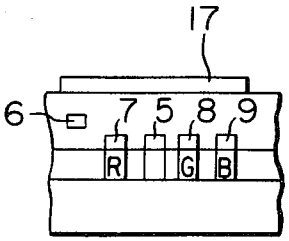

The photosensitive members in FIGS. 10 and 11 are further modified ones of the photosensitive member as shown in FIG. 9.

In FIG. 10, a transparent electrode 6 is provided in the middle of the photoconductive layer. In FIG. 11, the transparent electrode is not formed in a pattern-like state, but is formed as a continuous layer 18.

In the photosensitive members shown in FIGS. 1, 8 and 9–11, the isolated conductive member may be in other optional shapes such as a circle, a hexagon, and the like. Also, the shape of each electrode is not limited to a comb-shape; the shape may be a dot shape whose production is rather complicated. With regard to the colored filter electrode, colored filter electrodes having no filter layer 10 shown in FIG. 1 may be formed by forming electrodes with a conductive material having filter action.

The number of types of colored filter electrodes in the photosensitive member is suitably increased or decreased depending upon the type of colored image to be formed. For example, in case a colored image is formed by copying a colored original consisting of black and red with regard to the photosensitive member shown in FIG. 1, a photosensitive member may be used in which cyan filter electrodes which absorb only the red light of an original which is formed, instead of red filter electrodes, and it is not necessary to provide green filter electrodes and blue filter electrodes in the photosensitive member. By using such photosensitive member, development by the red toner is carried out according to the above-mentioned Step 2 and then development by the black toner is carried out according to the Step 4, and the resulting toner images are transferred to a paper to produce colored images consisting of black and red. In this case, if a blue toner is used in place of the red toner, the portions corresponding to the red portions of the original color images consisting of red and black can be changed to blue.

In a similar manner as above, by changing the color filter electrodes to magenta filter electrodes or yellow filter electrodes, it is possible to produce any optional colored images such as black and green colored images, black and blue colored images, red and green colored images, green and blue colored images, or the like.

In the color electrophotographic process according to the present invention, since voltage applied between the colored filter electrodes and the non-transparent electrodes is easily varied for every colored filter electrode, change of tone can be easily carried out by varying the voltage.

EXAMPLE

Gelatin was uniformly coated in the thickness of about 1 micron on a glass plate of 10 cm square, and the thus obtained gelatin layer was selectively colored by dyes of red, green and blue in the predetermined pattern form by means of photoresist to form a filter layer in which each colored filter of five microns wide of colorless, red, green and blue was arranged in parallel. The distance between two adjacent filters was 15 microns.

Then, $In_2O_3$ was deposited by vacuum evaporation at intervals of five microns and at five microns in width on the foregoing colored filters by a mask method. The resulting member was gradually oxidized in $O_2$ at 50° C. to form a pattern of transparent electrodes.

Further, Cr was deposited between the color filters according to a mask method by means of vacuum evaporation to produce non-transparent electrodes of 5000Å thick.

Thus, electrodes shown in FIG. 2 were produced.

Then, Se-Te alloy (Te: 20% by weight) was deposited by vacuum evaporation on the resulting member to form a photoconductive layer of 20 microns in thickness. The substrate was kept at 60° C.

Then, aluminum was deposited by vacuum evaporation in the thickness of about 6000Å to form isolated conductive members as shown in FIG. 3. Thus, a photosensitive member shown in FIG. 1 was produced.

Formation of a multi-colored image was then carried out by using such photosensitive member as follows. In FIG. 4, voltage of 500V was applied between electrodes 5 and 7 in such a manner that the side of the electrodes 7 was earthed, and image exposure was carried out. Then development was carried out by a magnetic brush to which negative cyan toner adhered so that the cyan toner adhered onto the isolated conductive members corresponding to cyan color, that is, the isolated conductive members corresponding to green, blue and cyan images as shown in FIG. 5. At this time, a voltage of +100V was applied to the magnetic brush.

Alternatively, a cyan toner can be attached to the isolated conductive members corresponding to only green, blue, and cyan images by applying +100V to the 7 side, applying +600V to the 5 side, applying +200V to the magnetic brush and developing with a negative toner; applying −100V to the 7 side, applying +400V to the 5 side, earthing the magnetic brush and developing with a negative toner; or applying +500V to the 7 side, earthing the 5 side, applying +300V to the magnetic brush, and developing with a positive toner.

Then, a paper was overlaid on the isolated conductive members of the photosensitive member, and a metallic electrode was overlaid on the paper. Thereafter, a voltage of 500V was applied to the metallic electrode, and the electrodes 5 and 7 of the photosensitive member were earthed to transfer the cyan toner adhering to the isolated conductive members of the photosensitive member to the paper.

Then, 500V was applied between electrodes 5 and 8 in such a manner that the side of the electrodes 8 was earthed, and an imagewise exposure was carried out. In this state, development was carried out by a magnetic brush on which negative magenta toner adhered so that the magenta toner only adhered to the isolated conductive members corresponding to the magenta color of the original as shown in FIG. 5, that is, the isolated conductive members corresponding to red, blue and magenta portions of the original. At this time, +100V was applied to the magnetic brush.

Then, the foregoing paper bearing the cyan toner was placed at the same place on the isolated conductive members of the photosensitive member as above, and the metallic electrode was overlaid on the paper. Thereafter, 500V was applied to the metallic electrode, and the electrodes 5 and 7 of the photosensitive member were earthed to transfer the magenta toner adhering to the isolated conductive members of the photosensitive member to the paper. Next, 500V was applied between electrodes 5 and 9 in such a manner that the side of the electrode 9 was earthed, and an image exposure was carried out. In this state, development was carried out by a magnetic brush on which negative yellow toner adhered so that the yellow toner only adhered to the isolated conductive members corresponding to yellow color of the original as shown in FIG. 6, that is, the isolated conductive members corresponding to green, red and yellow portions of the original. At this time, +100V was applied to the magnetic brush.

Thereafter, the foregoing paper bearing the cyan toner and the magenta toner was placed at the same place on the isolated conductive members of the photoconductive member as above, and the metallic electrode was overlaid on the paper. Thereafter, 500V was applied to the metallic electrode, and the electrodes 5 and 7 of the photosensitive member were earthed to transfer the yellow toner adhering to the isolated conductive members of the photosensitive member to the paper.

Next, 500V was applied between electrodes 5 and 6 in such a manner that the side of the electrodes 6 was earthed, and an image exposure was carried out by projecting an original light image containing white, black, red, blue, green, cyan, magenta and yellow colors from the substrate (glass plate) side. In this state, development was carried out by a magnetic brush onto which negative black toner adhered so that the black toner adhered to isolated conductive members as shown in FIG. 7. At this time, +100V was applied to the magnetic brush.

Thereafter, the foregoing paper bearing the yellow toner, the cyan toner, and the magenta toner was placed at the same place on the isolated conductive members of the photoconductive member as above, and the metallic electrode was overlaid on the paper. Thereafter, 500V was applied to the metallic electrode, and the electrodes 5 and 6 of the photosensitive member were earthed to transfer the black toner adhering to the isolated conductive members of the photosensitive member to the paper.

The multi-colored image of the original was reproduced by the foregoing process.

Thereafter, the surface of the paper was irradiated with an infrared lamp to heat the surface at a temperature higher than 200° C. Thereby, the toners were molten to fix the toners.

What we claim is:

1. A color electrophotographic process which comprises:

applying voltage between a non-transparent electrode and a color filter electrode of an electrophotographic photosensitive member comprising isolated conductive members forming picture elements, a photoconductive layer, non-transparent electrodes and color filter electrodes;

conducting imagewise exposure from the side where color filter electrodes are arranged, resulting in formation of a difference in distribution voltage between the area wherein light passes through the color filter electrode and the area wherein light does not pass through the color filter electrode with regard to the voltage distribution between the non-transparent electrode and the isolated conductive member and between the color filter electrode and the isolated conductive member;

thereby forming a voltage image depending upon the change of the voltage of the isolated conductive member caused corresponding to a difference in distribution voltage; and developing said voltage image with a color toner corresponding to a color light passing through the color filter electrode.

2. A color electrophotographic process which comprises:

a step comprising applying voltage between a non-transparent electrode and a color filter electrode of an electrophotographic photosensitive member comprising isolated conductive members forming picture elements, a photoconductive layer, transparent electrodes, non-transparent electrodes and color filter electrodes, conducting imagewise exposure from the side where color filter electrodes are arranged, resulting in formation of a difference in distribution voltage between the area wherein light passes through the color filter electrode and the area wherein light does not pass through the color filter electrode with regard to the voltage distribution between the non-transparent electrode and the isolated conductive member and between the color filter electrode and the isolated conductive member, thereby forming a voltage image depending upon the change of the voltage of the isolated conductive member caused corresponding to a difference in distribution voltage, and developing said voltage image with a color toner corresponding to a color light passing through the color filter electrode; and a step comprising applying voltage between a transparent electrode and a non-transparent electrode, conducting imagewise exposure from the side where non-transparent electrodes are arranged, resulting in formation of a difference in distribution voltage between the area wherein light passes through the transparent electrode and the area wherein light does not pass through the transparent electrode with regard to the voltage distribution between the non-transparent electrode and the isolated conductive member and between the transparent electrode and the isolated conductive member, thereby forming a voltage image depending upon the change of the voltage of the isolated conductive member caused corresponding to a difference in distribution voltage, and developing said voltage image with a black toner.

3. An electrophotographic photosensitive member for the color electrophotographic process as defined in claim 1 or 2 which comprises isolated conductive members forming picture elements, a photoconductive layer, non-transparent electrodes and color filter electrodes.

4. An electrophotographic photosensitive member according to claim 3 wherein transparent electrodes are provided.

5. An electrophotographic photosensitive member which essentially consists of isolated conductive members forming picture elements, a photoconductive layer, non-transparent electrodes and color filter electrodes.

6. An electrophotographic photosensitive member which comprises isolated conductive members forming picture elements, a photoconductive layer, non-transparent electrodes and color filter electrodes, one non-transparent electrode and one color filter electrode being combined as a pair and the pairs being repeatedly arranged.

* * * * *

UNITED STATES PATENT AND TRADEMARK OFFICE

CERTIFICATE OF CORRECTION

PATENT NO. : 4,439,504

DATED : March 27, 1984

INVENTOR(S) : ISHIHARA, ET AL.

It is certified that error appears in the above-identified patent and that said Letters Patent is hereby corrected as shown below:

Col. 1, line 28, "image forming" to --image forming--.
Col. 3, line 5, "developin" to --developing--.
Col. 3, line 56, "Kayanal" to --Kayanol--.
Col. 4, line 34, "Kayanal" to --Kayanol--.
Col. 4, line 53, "Kayanal" to --Kayanol--.
Col. 6, line 29, "to black" to --to black--.
Col. 7, line 7, "Vo = 0" to --Vo ≃ 0--.
Col. 7, line 60, "Vo = 0" to --Vo ≃ 0--.
Col. 8, line 44, "Vo = 0" to --Vo ≃ 0--.
Col. 8, line 65, after "earthed" insert --,--.
Col. 9, line 40, "Vo = 0" to --Vo ≃ 0--.

Signed and Sealed this

*Twenty-ninth* Day of *January 1985*

[SEAL]

*Attest:*

DONALD J. QUIGG

*Attesting Officer* *Acting Commissioner of Patents and Trademarks*